US006930642B2

(12) United States Patent
Kossiavas et al.

(10) Patent No.: US 6,930,642 B2
(45) Date of Patent: Aug. 16, 2005

(54) COMPACT MULTIBAND ANTENNA

(75) Inventors: Georges Kossiavas, Saint Paul (FR); Robert Staraj, Saint Paul (FR); Hervé Legay, Plaisance Du Touch (FR); Jean-Marc Carrere, Grasse (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/478,859

(22) PCT Filed: Jun. 10, 2002

(86) PCT No.: PCT/FR02/01973

§ 371 (c)(1),
(2), (4) Date: Nov. 25, 2003

(87) PCT Pub. No.: WO02/101874

PCT Pub. Date: Dec. 19, 2002

(65) Prior Publication Data

US 2004/0155823 A1 Aug. 12, 2004

(30) Foreign Application Priority Data

Jun. 12, 2001 (FR) ..... 01 07689

(51) Int. Cl.[7] ..... H01Q 1/24

(52) U.S. Cl. ..... 343/702; 343/770; 343/846

(58) Field of Search ..... 343/702, 700 MS, 343/767, 770, 846, 848

(56) References Cited

U.S. PATENT DOCUMENTS

| | | | | |
|---|---|---|---|---|
| 5,943,020 | A | * 8/1999 | Liebendoerfer et al. | 343/702 |
| 5,986,606 | A | * 11/1999 | Kossiavas et al. | 343/700 MS |
| 6,049,314 | A | * 4/2000 | Munson et al. | 343/846 |
| 6,348,892 | B1 | * 2/2002 | Annamaa et al. | 343/700 MS |
| 2002/0140607 | A1 | * 10/2002 | Zhou | 343/700 MS |

FOREIGN PATENT DOCUMENTS

| | | |
|---|---|---|
| EP | 0 777 295 A2 | 6/1997 |
| EP | 0 795 926 A2 | 9/1997 |
| EP | 1 085 595 A2 | 3/2001 |
| EP | 1 094 545 A2 | 4/2001 |

* cited by examiner

*Primary Examiner*—Hoang V. Nguyen
(74) *Attorney, Agent, or Firm*—Sughrue Mion, PLLC

(57) ABSTRACT

The present invention provides a multiband antenna (1) comprising: a plane type ground element (11); a plane type "lower" active radiating element (2) including at least one "lower" slot (9); a plane type "upper" active radiating element (3) including at least one "upper" slot (10); a first short circuit element (4) electrically connecting said lower element to said upper element; a second short circuit element (5) also connecting said lower element to said ground element; a primary signal source (7); a "lower" thin sheet (12) of a first dielectric material; and an "upper" thin sheet (13) of a second dielectric material. The antenna also has a third short circuit element (6) electrically connecting said lower element and said ground element, and at least one lower slot and at least one upper slot are radiating slots.

25 Claims, 5 Drawing Sheets

COMPACT MULTIBAND ANTENNA

BACKGROUND OF THE INVENTION.

The present invention relates in general terms to a telecommunications device for sending and receiving waves having wavelength λ, typically used in a spectral range including radio frequencies and microwave frequencies. More particularly, the invention relates to a multiband antenna.

In known manner, the size and the weight of wireless communications systems, such as multimode terminals (terrestrial, satellite) or pocket telephone terminals, are continuously being reduced by ever greater integration of electronic circuits. For example, for pocket telephone terminals, it is desired to improve user mobility. For this purpose, efforts have been made to obtain an antenna of transverse dimensions and of height that are small, the antenna still remaining the bulkiest part of such systems. Furthermore, the appearance of the antenna should not be unsightly for the user, so hiding it completely has also become a priority.

Miniaturizing an antenna influences firstly the resonant frequency of the overall structure, which frequency is offset towards higher frequencies. In addition, miniaturization directly influences the radio properties of the structure, constituted mainly by matching, appearance of the radiation pattern, and passband. Reducing the size of an antenna generally leads to matching that is difficult, a reduction in efficiency, degradation of the radiation pattern associated with high sensitivity to the surroundings, and above all a major decrease in the width of the passband because of a Q factor that is high.

A compromise is generally made between antenna performance (good matching, controlled omnidirectional radiation, large passband) and overall size, complexity of the structure, and cost.

The objective of miniaturization generally leads to superposing two plane type radiating elements, creating a resonant frequency that depends on their dimensions. The planes are connected to a ground plane of dimensions that are larger, but nevertheless as small as possible, thus making it possible in particular to limit the sensitivity of the antenna to the surroundings.

U.S. Pat. No. 5,986,606 discloses a miniature antenna. In the second embodiment described therein, the height of the antenna is about 4.5 millimeters (mm). It comprises a ground plane having superposed thereon in parallel a "lower" rectangular radiating plane, and above that a "upper" rectangular radiating plane of the same dimensions. It has an operating frequency $f_1$. The planes are interconnected by a substantially square short circuit plane at the bottom sides of their widths, and placed beside one of the long sides of said planes. A thin sheet of air fills the space between the bottom plane and the ground plane. Another thin sheet, this time of dielectric material having relative permittivity $\in_r$ greater than 1 fills the space between the lower plane and the upper plane. The upper plane is also connected by a short circuit parallel to the short circuit plane. These short circuits lengthen the electrical length so as to lower the frequency $f_1$. A primary signal source feeds the lower plane. Both planes are thus of the active type. In addition, each of the radiating planes possesses a broad slot made in the width direction, of length shorter than the width. These slots are of the same dimensions, parallel, and made in the same position in each plane which thus becomes C-shaped. Like the short circuit elements, they lengthen the electrical length and thus lower the frequency $f_1$. The "double C" antenna operates at a frequency around 1.5 gigahertz (GHz) with a narrow passband of 0.5% for a standing wave ratio (SWR) less than or equal to 2.

Such an antenna can operate in a "high" frequency range, e.g. corresponding to the digital cellular system (DCS) standard of 1710 megahertz (MHz) to 1880 MHz, or the personal communication system (PCS) standard operating in the range 1850 MHz to 1990 MHz, without, a fortiori, being of two-band nature. Thus, that antenna cannot operate simultaneously in the "high" band and in a "low" frequency band corresponding for example to the global system for mobile communications (GSM) standard (890 MHz to 960 MHz) or to the advanced mobile phone system (AMPS) standard (824 MHz–896 MHz).

SUMMARY OF THE INVENTION.

The object of the invention is to associate techniques of miniaturization, passband broadening, and multifrequency operation so as to obtain multiband operation with a single antenna. This made possible by incorporating specific additional resonators in the miniaturized antenna.

To this end, the invention provides a multiband antenna comprising:

a plane type ground element;

a plane type "lower" active radiating element superposed on and parallel with said ground element, and including at least one "lower" slot;

a plane type "upper" active radiating element superposed on and parallel with said lower element, and including at least one "upper" slot;

said lower element being electrically connected to said upper element by a first short circuit element, and said lower element also being connected to said ground element by a second short circuit element;

a primary signal source connected at one end to a generator and fixed at its other end to one of said radiating elements;

a "lower" thin sheet of a first dielectric material filling a space between said lower element and said ground element; and an "upper" thin sheet of a second dielectric material filling a space between said lower and upper elements;

the antenna being characterized in that it further comprises a third short circuit element electrically connecting said lower element and said ground element, and in that at least one lower slot and at least one upper slot are radiating slots.

In this specification, the term "radiating" means giving rise to resonance.

The antenna of the invention is flat and integrates miniaturization techniques (element superposition). The thicknesses of the thin sheets of the invention can be small, and the lower and upper elements can be of small dimensions so that the overall size and weight of the antenna are small and suitable for multimode terminals or for pocket terminals. Thus, the antenna of the invention can be fixed, for example, to the rear wall of a pocket terminal.

In addition, the short circuit elements impart mechanical stiffness to the antenna. The materials used for making the antenna are selected from inexpensive materials.

The antenna is capable of multifrequency operation stemming from multiple resonances. In outline, the first resonance corresponds to the fundamental resonance of the lower and upper radiating elements and gives an operating frequency $f_1$. Another resonance associated with the resonance of the second and third short circuit elements gives an operating frequency $f_2$. In addition, the antenna of the invention has two further resonances created by the lower and upper radiating slots having respective operating frequencies $f_3$ and $f_4$. In addition, adding these lower and upper slots which act as resonators does not increase the overall size of the antenna.

The number, the nature, and the dimensions of the various elements and the ways in which they are arranged relative to one another provide the advantage of enabling both the operating frequencies and also the shape of the radiation pattern of the antenna to be adjusted as a function of the intended coverage.

An antenna of the invention can thus satisfy the need for miniature multiband antennas for portable terminals operating in a plurality of standards that are very far apart: the low GSM band, the high DCS band (1710 MHz–1880 MHz), and the bands allocated to the universal mobile telecommunications system (UMTS) standard (1885 MHz–2025 MHz) and (2110 MHz–2200 MHz).

Similarly, the antenna of the invention can be integrated, for example, in a multimode terminal and it can operate in the satellite band (1980 MHz–2200 MHz).

By way of example, it is advantageous to set the frequency $f_1$ in the GSM band, and the frequency $f_2$ in the DCS and/or UMTS band, and to associate them with frequencies $f_3$ and $f_4$ so as to obtain at least two bands that are broad.

Thus, the GSM band may be obtained by double resonance by associating the frequencies $f_1$ and $f_4$. Similarly, the DCS and/or the UMTS band can be obtained by double resonance by associating the frequencies $f_2$ and $f_3$.

Because of its small size, the antenna of the invention can be sensitive to different polarizations. Advantageously, advantage can be taken of the absence of polarization purity in a portable terminal in urban surroundings where coupling between polarizations is important, since it encourages radiation that is relatively omnidirectional.

Thus, the radiation pattern is such that the antenna operates in satisfactory manner in different positions in the vicinity of objects.

Advantageously, the dimensions of the lower and upper elements may be significantly smaller than the dimensions of the ground element in order to obtain an antenna of the invention that is as small as possible in size.

Preferably, the dimensions of the lower and upper elements may be substantially identical in order to simplify the shape of the antenna and in order to simplify manufacture thereof.

According to the invention, the other end of the source may be fixed to the upper element.

According to the invention, the first and second dielectric materials may be air.

According to the invention, the lower and upper radiating slots may be of lengths respectively greater than the greatest dimension of each of the lower and upper elements.

In this way, electrical length is elongated so that the frequency $f_1$ is lowered.

Advantageously, the lower and upper radiating slots of the invention may be of different sinuous shapes.

Thus, the sinuous shape serves to optimize slot length. Slots of different shapes enable better performance to be obtained from the antenna.

Advantageously, the lower and upper radiating slots of the invention may comprise a plurality of continuous segments. The segments of the lower radiating slot may be of widths of less than 0.5 mm, and the segments of the upper radiating slots may be of widths of less than 0.5 mm.

Thus, the radiating slots are sufficiently narrow to cause resonances to appear.

Preferably, in accordance with the invention, the set of segments may be substantially of the same width so as to simplify manufacture thereof, and the width is preferably equal to 0.1 mm.

In a preferred embodiment of the invention, the lower and upper elements and the ground element may be substantially rectangular.

In an embodiment of the invention, the first short circuit element may be of the plane type and the second and third short circuit elements of the invention may be of the wire type.

In this latter embodiment of the invention, the second and third short circuit elements of the wire type may then be disposed in a director plane that is not parallel to the first short circuit element of the plane type, and that is substantially orthogonal thereto, for example.

The length of the lower radiating slot of the invention is preferably greater than 65 mm and the length of the upper radiating slot of the invention is greater than 70 mm.

In an advantageous embodiment, the lower radiating slot may be open-ended in the sense that at least one segment terminates in the edge of the lower element. Its segments may be orthogonal and there may be four of them, the longer two segments being made in the long direction of the lower element. In addition, the upper radiating slot may also be open-ended and its segments may be orthogonal and four in number, the longer two segments likewise being made in the long direction of the upper element.

It is important to adjust the characteristics of the antenna of the invention in one band without affecting its characteristics in the other band, and in particular it is important to enlarge one passband of the antenna without affecting the other passband. Thus, a precise methodology for designing the antenna has been developed, specifying the various techniques to be implemented and how they should be sequenced. Thus, the particular above-specified geometry makes it possible to provide resonances that can be astutely coupled so as to match the antenna to two broad bands—a low band and a high band—without the operating mode of the antenna in one or the other band being significantly affected. In addition, choosing to make the segments orthogonal at the design stage enables manufacture to be simplified.

In a first embodiment of the invention, the rectangular radiating elements may be disposed substantially in the vicinity of the middle of the rectangular ground element, the long directions of the lower and upper rectangular elements being parallel to the long direction of the ground element.

In a second embodiment of the invention, the radiating elements may be disposed substantially in the vicinity of one end of the ground element, the width directions of the lower and upper elements being parallel to the long direction of the ground element.

In the invention, the first short circuit element may be substantially orthogonal to said ground elements.

The invention also provides a radiocommunications terminal including such an antenna.

The characteristics and objects of the present invention appear from the following detailed description given with reference to the accompanying figures that are presented by way of non-limiting illustration.

DETAILED DESCRIPTION OF THE INVENTION.

Figure 1:
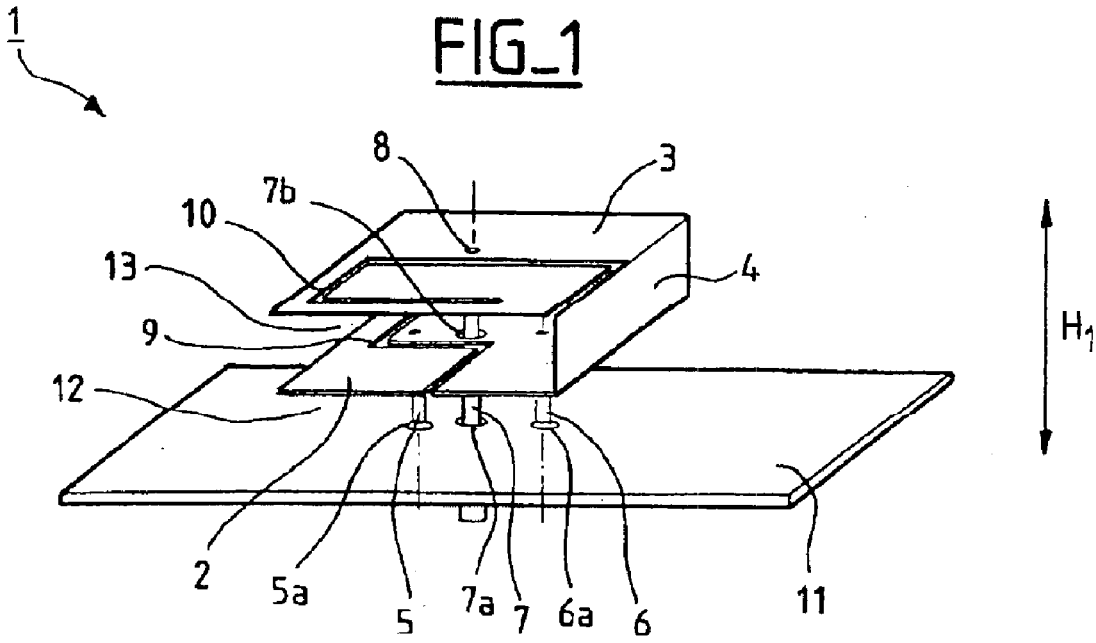
FIG. 1 is a perspective view of an antenna of the invention in a first embodiment of the invention.

FIG. 1 shows an antenna 1 of the invention comprising a ground plane 11, a lower radiating plane 2 which is rectangular and superposed in parallel with the ground plane 11, and an upper radiating plane 3 that is rectangular, and identical with, superposed on, and parallel to the lower radiating plane 2.

The lower and upper planes 2 and 3 are disposed substantially in the vicinity of the middle of the ground plane 11, with the long directions of these planes 2 and 3 being parallel to the long direction of the ground plane 11. In addition, these planes 2 and 3 are made of metal and are of identical dimensions, and they respectively comprise a lower radiating slot 9 and an upper radiating slot 10 of different sinuous shapes.

The lower plane 2 is electrically connected to the upper plane 3 by a metal short circuit 4 plane perpendicular thereto and bonded to one of their sides extending in the width direction. The lower plane 2 is also connected to the ground plane 11 via two metal wire short circuits 5 and 6.

A primary signal source 7 is connected at one end to a generator (not shown) and passes through an opening 7*a* in the ground plane 11 and then through an opening 7*b* in the lower plane 2, and is fixed by bonding 8 to the upper plane 3.

The wire short circuits 5 and 6 are situated on either side of the source 7. Their connection positions with the ground plane 11 are referenced 5*a* and 6*a*. In addition, the wire short circuits 5 and 6 are disposed in a director plane (not shown) which is orthogonal to the plane of the short circuit 4.

A lower thin sheet of air 12 fills the space between the lower plane 2 and the ground plane 11. Similarly, an upper thin sheet of air 13 fills the space between the lower and upper planes 2 and 3.

The height $H_1$ of the antenna 1 is 12.5 mm.

Figure 2:
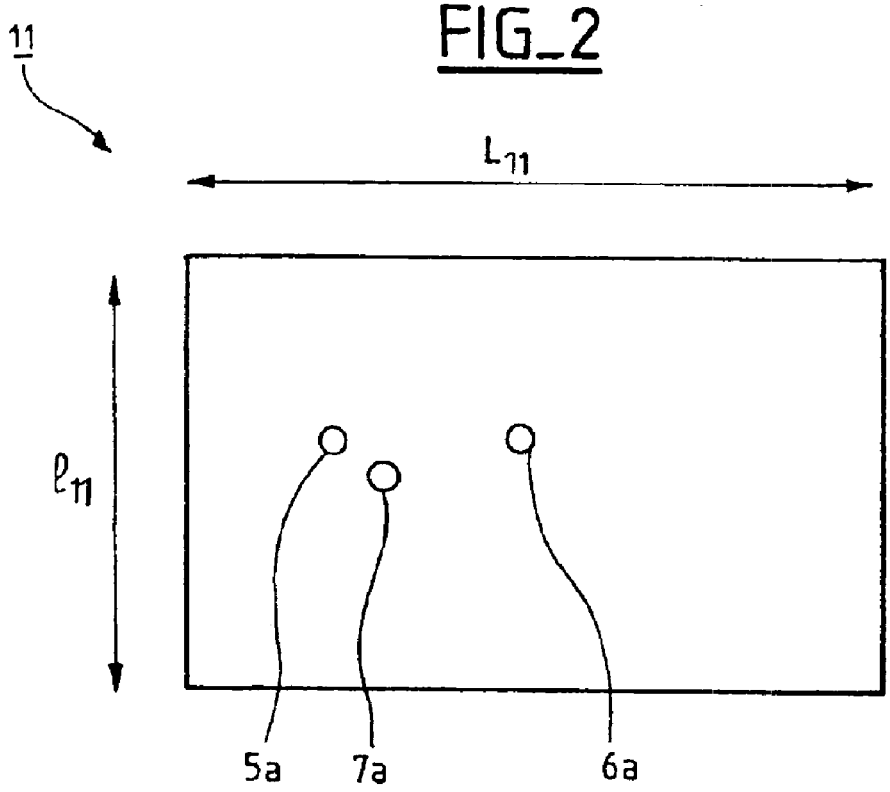
FIG. 2 is a plan view of the ground plane of the FIG. 1 antenna.

FIG. 2 is a view from above of the ground plane 11 of the antenna 1. This ground plane 11 is of length $L_{11}$ equal to 60 mm and of width $l_{11}$ equal to 40 mm. Starting from the connection positions 5*a* and 6*a,* it can be seen that the wire short circuits 5 and 6 are not in alignment with the source 7, and are disposed in a director plane (not shown) parallel to the long direction $L_{11}$.

Figure 3:
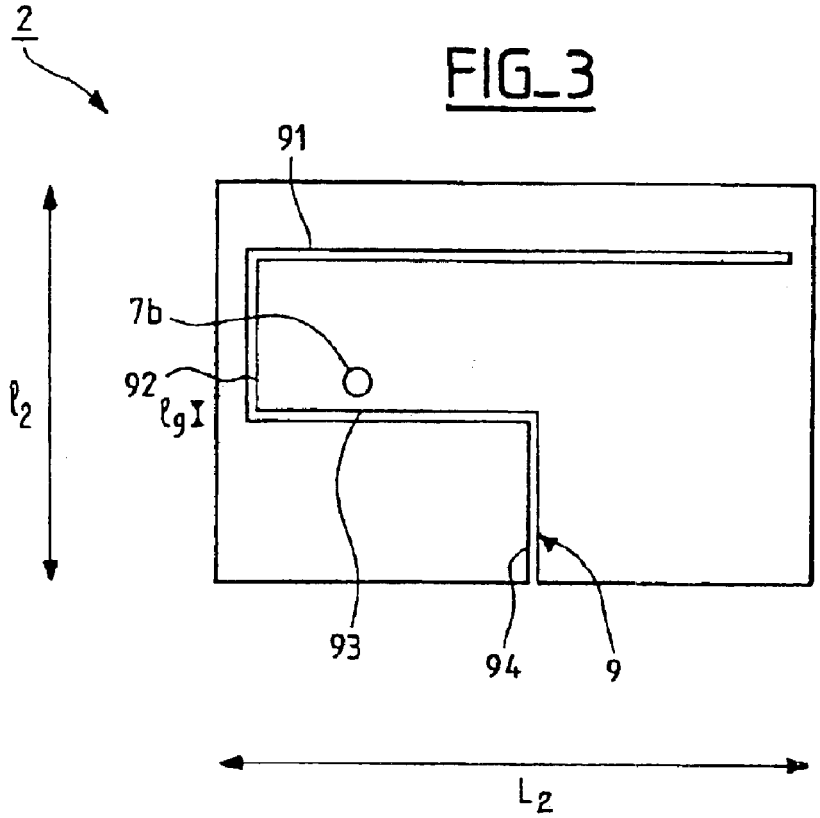
FIG. 3 is a plan view of the lower radiating plane of the FIG. 1 antenna.

FIG. 3 is a view from above of the lower plane 2 of the antenna 1. This lower plane 2 is of length $L_2$ equal to 35 mm and of width $l_2$ equal to 25 mm. The lower slot 9 also shown in the figure is open-ended and comprises four continuous and orthogonal segments 91, 92, 93, and 94. The longer two segments 91 and 93 extend in the length direction of the lower plane 2. It should be observed that the segment 93 is close to the opening 7*b*.

The positioning of the feed source 7 close to the slots 9 and 10 makes it possible to match (SWR<2) the resonances of the slots with the desired frequencies (in this case GSM frequencies and UMTS frequencies), and also allows sufficient energy to be transferred to ensure that the slots 9 and 10 radiate.

The segments 91, 92, 93, and 94 are substantially of the same width $l_9$ which is preferably about 0.1 mm. The total length of the lower slot 9 is about 68 mm.

Figure 4:
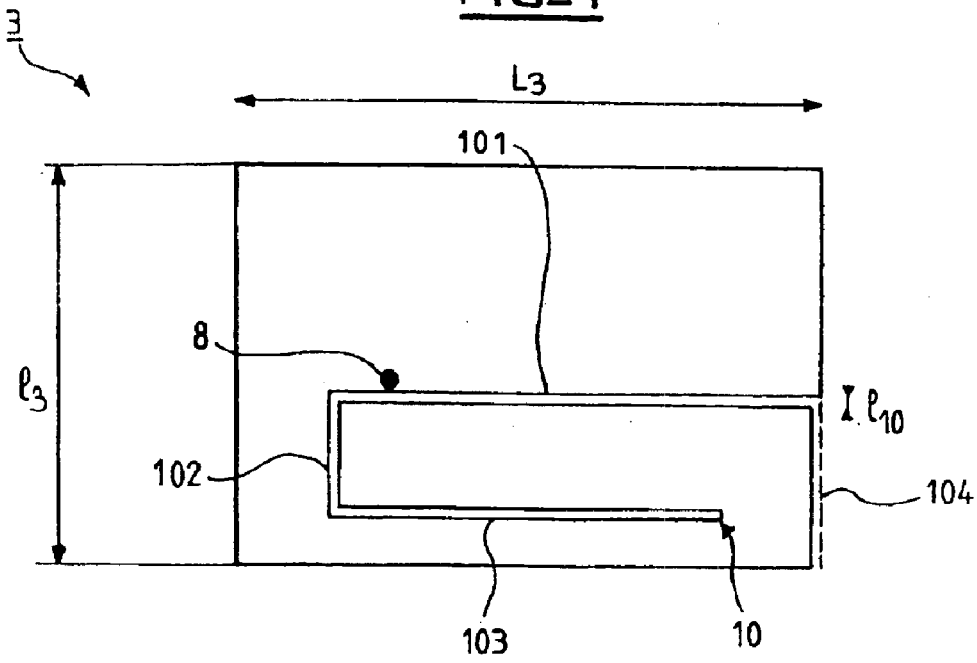
FIG. 4 is a plan view of the upper radiating plane of the FIG. 1 antenna.

FIG. 4 is a view from above of the upper plane 3 of the antenna 1. This upper plane 3 is of length $L_3$ equal to 35 mm, and of width $l_3$ equal to 25 mm. The upper slot 10 also shown in the figure is open-ended and has four continuous and orthogonal slots 101, 102, 103, and 104. The longer two slots 101 and 103 extend in the long direction of the upper plane 3. The segment 104 extends in full along one of the sides extending in the width direction of the upper plane 3.

The segments 101, 102, 103, and 104 are of substantially the same width $l_{10}$, which is preferably about 0.1 mm. The total length of the upper slot 10 is about 75 mm.

It should be observed that the segment 101 comes close to the connection 8 and that the segments 101, 102, and 103 are not superposable with the segments 91, 92, 93, or 94.

The overall size of the antenna 1 having dimensions 60 mm×40 mm×12.5 mm is thus very small.

The antenna 1 possesses multifrequency operation stemming from four resonances. In outline, the first resonance of operating frequency f1 situated in the low band corresponds to the fundamental resonance in the lower and upper planes 2, 3. The second resonance of operating frequency f2 situated in the high band is associated with the resonance of the wire short circuits 5, 6. In addition, two additional resonances of operating frequencies f3 and f4 at a ratio of close to 2 are created respectively by the lower slot 9 and by the upper slot 10. Specifically, these two resonances come from mutual disturbances between the two slots 9 and 10. They are situated respectively in the high band and in the low band.

The operating frequencies are adjusted by optimizing the dimensions of the various elements and their arrangements relative to one another.

The term "element" is used herein to mean not only the metal structure (lower plane 2, upper plane 3), but also the slots 9, 10, the ground plane 11, the short circuits 5, 6, and the primary source 7.

The term "arrangements" is used to cover:

the arrangement of the lower and upper planes 2 and 3 relative to the ground plane 11;

the arrangement of the short circuits 5, 6 relative to the lower plane 2 and relative to the slots 9, 10;

the arrangement of the slots 9, 10 relative to the lower and upper planes 2 and 3, and relative to the source 7; and the arrangement of the upper slot 10 relative to the lower slot 9.

The slots 9 and 10 also serve to lengthen the electrical lengths so as to lower the frequency $f_1$. In addition, the slots 9, 10 are made in such a manner that the resonances at frequencies $f_1$ and $f_2$ are little affected.

Furthermore, the use of a plurality of wire short circuits 5, 6 in relative positions that are accurately determined relative to the position of the plane short circuit 4 enables proper operation of the antenna 1 to be obtained.

Furthermore, the spacing between the frequencies $f_1$ and $f_2$ is obtained by the way in which the wire short circuits 5, 6 are associated, and it is adjusted by the upper slot 10.

Thus, four resonances $f_1$ to $f_4$ couple together in pairs and give rise to two broad passbands, one in the low band and the other in the high band.

Figure 5:
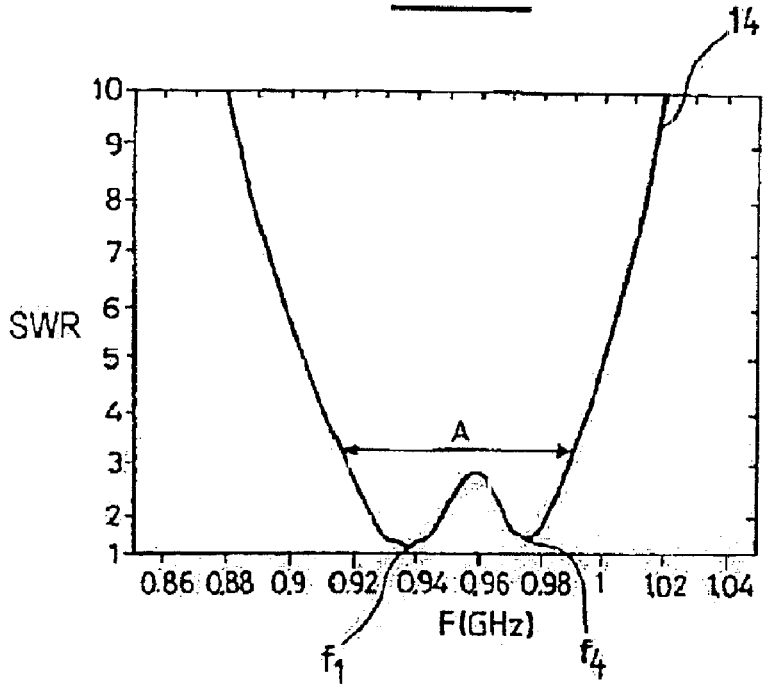
FIG. 5 shows the SWR in the high band of the FIG. 1 antenna.
Figure 6:
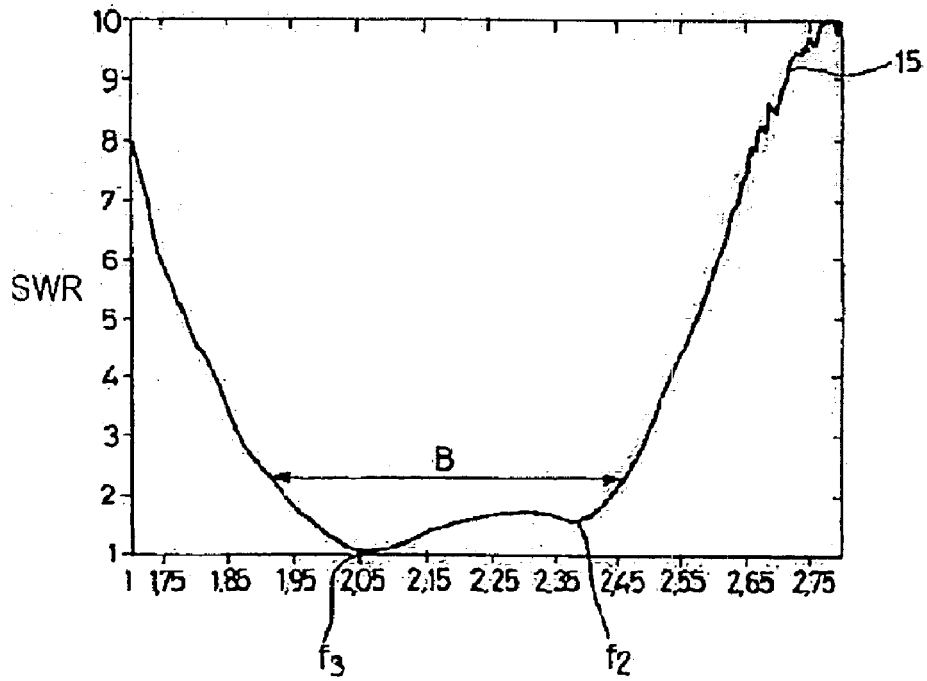
FIG. 6 shows the SWR in the low band of the FIG. 1 antenna.

The SWR characteristic of the matching of the antenna 1 is shown by curve 14 in FIG. 5 for the low band and by curve 15 in FIG. 6 for the high band.

Optimum operating frequencies $f_1$ and $f_4$ are obtained that are equal to about 935 MHz and 980 MHz giving a passband A equal to about 7% (about 70 MHz) for an SWR that is less than or equal to 3. The dimensions of the planes 2, 3 are thus less than $\lambda_1/10$ and those of the ground plane 11 are less than $\lambda_1/5$. Optimum operating frequencies $f_1$ and $f_2$ are obtained that are equal to 2050 MHz and 2370 MHz in a passband B equal to about 22% (about 500 MHz) for an SWR less than or equal to 2.

It should be observed that the frequencies are slightly offset towards lower frequencies once the antenna 1 is fitted in the housing of a terminal.

Figure 7:
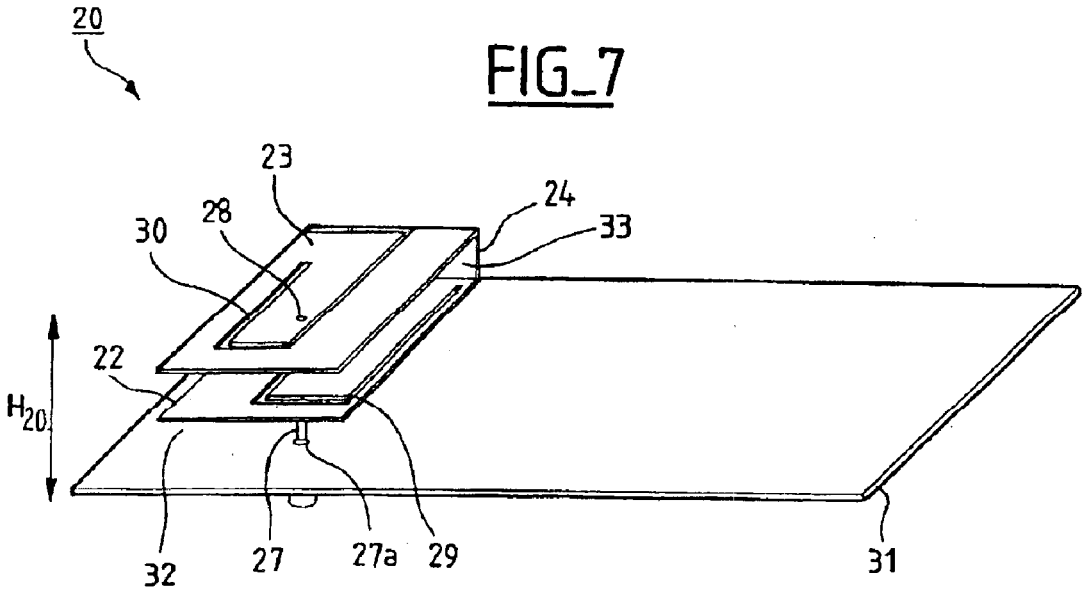
FIG. 7 is a perspective view of an antenna of the invention in a second embodiment of the invention.

FIG. 7 shows an antenna 20 of the invention comprising a ground plane 31, a lower radiating plane 22 that is rectangular and superposed parallel with the ground plane 31, and an upper radiating plane 23 that is rectangular, being superposed on and parallel with the lower radiating plane 22.

The lower and upper planes 22 and 23 are disposed substantially in the vicinity of a side of the ground plane 31 that extends in the width direction, and the width directions of the planes 22 and 23 are parallel to the length direction of the ground plane 31. In addition, the lower and upper planes 22 and 23 are made of metal and of dimensions that are identical, each of them having a respective lower or upper radiating slot 29 or 30 of different sinuous shape.

The lower plane 22 is electrically connected to the upper plane 23 by a metal short circuit plane 24 that extends perpendicularly and that is bonded thereto. The planes 22, 23, and 24 can thus be obtained by folding a rectangular metal plate. In addition, the lower plane 22 is also connected to the ground plane 31 by two metal wire short circuits (not shown).

A primary signal source 27 connected at one end to a generator (not shown) passes through an opening 27*a* in the ground plane 31 and then through an opening 27*b* (see FIG. 9) in the lower plane 22 and is bonded at 28 to the upper plane 23.

A thin lower sheet of air 32 fills the space between the lower plane 22 and the ground plane 11. Similarly, a thin upper sheet of air 33 fills the space between the lower plane 22 and the upper plane 23.

The height $H_{20}$ of the antenna 20 is 9.5 mm.

Figure 8:
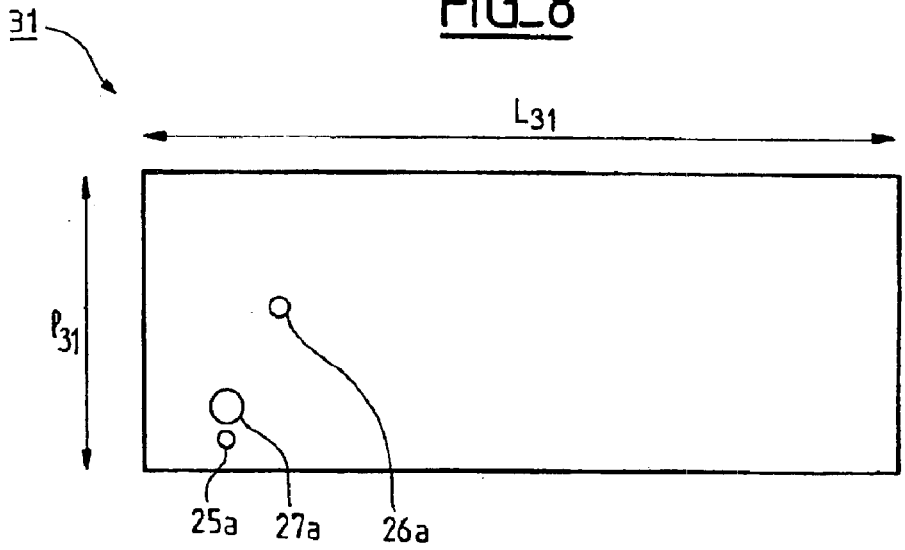
FIG. 8 is a plan view of the ground plane of the FIG. 7 antenna.

FIG. 8 is a view from above of the ground plane 31 of the antenna 20. This ground plane 31 is of length $L_{31}$ equal to 100 mm and of width $l_{31}$ equal to 40 mm. Starting from the connection positions 25*a* and 26*a* of the wire short circuits (not shown), it can be seen that these short circuits are not in alignment with the source 27, and are disposed in a director plane (not shown) that is not parallel with the plane of the short circuit 34.

Figure 9:
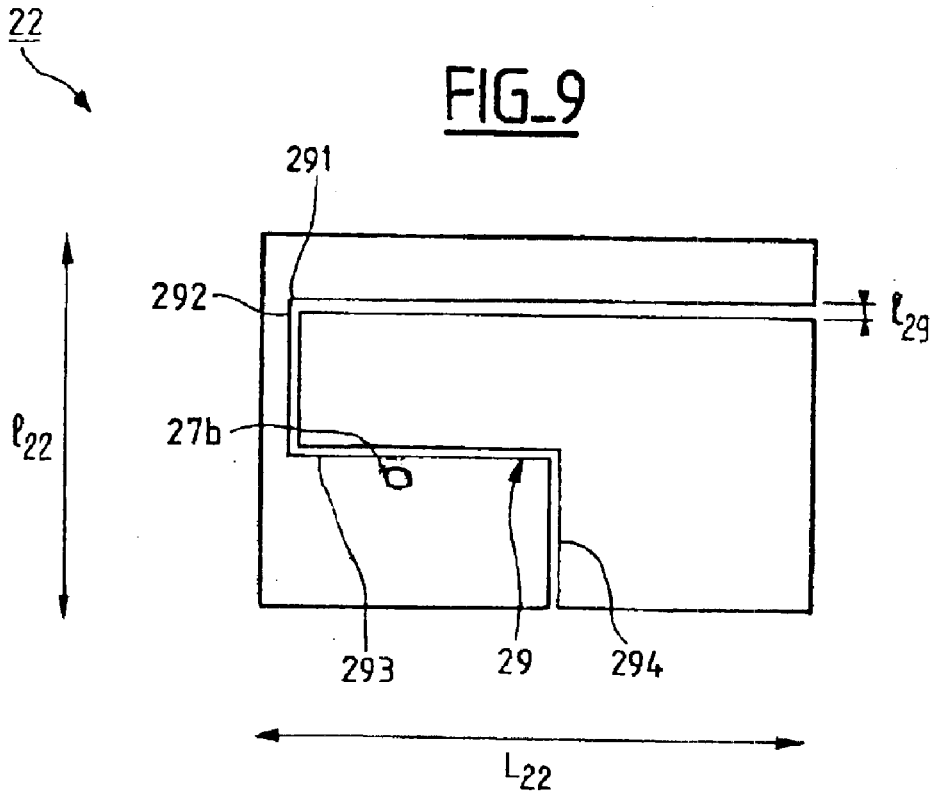
FIG. 9 is a plan view of the lower radiating plane of the FIG. 7 antenna.

FIG. 9 is a view from above of the lower plane 22 of the antenna 20. This lower plane 22 is of length $L_{22}$ equal to 35 mm and of width $l_{22}$ equal to 25 mm. The lower slot 29 is also shown and is open-ended having four continuous segments extending at right angles 291, 292, 293, and 294. The longer two segments 291 and 293 extend in the long direction of the lower plane 2. It should be observed that the segment 293 is close to the opening 27*b*.

The segments 291, 292, 293, and 294 are of substantially the same width $l_{29}$ which is preferably about 0.1 mm. The total length of the lower slot 29 is about 70 mm.

Figure 10:
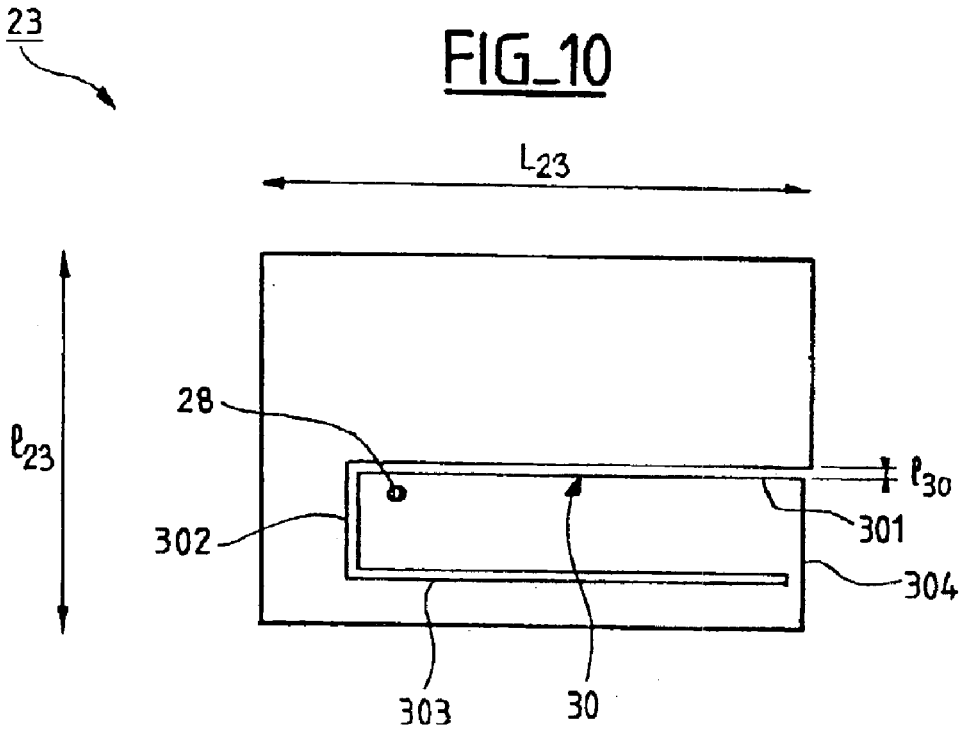
FIG. 10 is a plan view of the upper radiating plane of the FIG. 7 antenna.

FIG. 10 is a view from above of the upper plane 23 of the antenna 20. This upper plane 23 is of length $L_{23}$ equal to 35 mm and of width $l_{23}$ equal to 25 mm. The upper slot 30 also shown in the figure is open-ended and comprises four continuous segments extending orthogonally 301, 302, 303, and 304. The two longer segments 301 and 303 extend in the long direction of the upper plane 23. The segment 304 is situated totally in one of the sides of the upper plane 23 that extends in its width direction.

The segments 301, 302, 303, and 304 are of substantially the same width $l_{30}$ which is preferably about 0.1 mm. The total length of the upper slot 30 is about 75 mm.

It should be observed that the segment 301 is close to the connection 28 and that a portion of the segment 301 can be superposed over the segment 293.

The overall size of the antenna 20 of dimensions 100 mm×40 mm×9.5 mm is thus very small.

In identical manner to the antenna 1, the antenna 20 possesses four resonances $f_1$ to $f_4$ that are coupled together in pairs to give the antenna 20 function that is both multiband and broadband.

The SWRs, the passbands, and the radiation pattern of the antenna 20 are similar to those of the antenna 1.

Naturally, the above description is given purely by way of illustration. Without going beyond the ambit of the invention, any means may be replaced by equivalent means.

The radiating elements and the ground element may be shaped, for example.

It is also possible to imagine covering other standards by making additional slots, optionally open-ended slots, possibly associated with other radiating elements connected together by short circuit elements.

What is claimed is:

1. A multiband antenna (1, 20) comprising:

a plane type ground element (11, 31);

a plane type "lower" active radiating element (2, 22) superposed on and parallel with said ground element, and including at least one "lower" slot (9, 29);

a plane type "upper" active radiating element (3, 23) superposed on and parallel with said lower element, and including at least one "upper" slot (10, 30);

said lower element being electrically connected to said upper element by a first short circuit element (4, 24), and said lower element also being connected to said ground element by a second short circuit element (5);

a primary signal source (7, 27) connected at one end to a generator and fixed at its other end to one of said radiating elements;

a "lower" thin sheet (12, 32) of a first dielectric material filling a space between said lower element and said ground element; and an "upper" thin sheet (13, 33) of a second dielectric material filling a space between said lower and upper elements;

the antenna being characterized in that it further comprises a third short circuit element (6) electrically connecting said lower element and said ground element, and in that at least one lower slot and at least one upper slot are radiating slots, and said other end of said source (7, 27) is fixed to said upper element (3, 23).

2. A multiband antenna (1, 20) according to claim 1, characterized in that the dimensions of said lower and upper elements (2, 22; 3, 23) are substantially smaller than the dimensions of said ground element (11, 31).

3. A multiband antenna (1, 20) according to claim 1, characterized in that the dimensions of said lower and upper elements (2, 22; 3, 23) are substantially identical.

4. A multiband antenna (1, 20) according to claim 1, characterized in that said first and second dielectric material are air.

5. A multiband antenna (1, 20) according to claim 1, characterized in that said lower and upper radiating slots (9, 29; 10, 30) are each of a length that is greater than the longest dimension of each of said lower and upper elements (2, 22; 3, 23).

6. A multiband antenna (1, 20) according to claim 5, characterized in that said lower and upper radiating slots (9, 29; 10, 30) are of different sinuous shapes.

7. A multiband antenna (1, 20) according to claim 6, characterized in that said lower and upper radiating slots (9, 29; 10, 30) comprise a plurality of continuous segments (91 . . . 304), said segments of said lower radiating slots (91 . . . 294) are of widths less than 0.5 mm, and said segments of said upper radiating slots (101 . . . 304) are of widths less than 0.5 mm.

8. A multiband antenna (1, 20) according to claim 7, characterized in that all of said segments (91 . . . 304) are of substantially the same width which is equal to 0.1 mm.

9. A multiband antenna (1, 20) according to claim 7, characterized in that said lower radiating slot (9, 29) is open-ended and said segments of said lower radiating slot (91 . . . 294) are orthogonal and four in number, the longer two segments being made in the long direction of said lower element (2, 22), and in that said upper radiating slot (10, 30) is open-ended and said segments of said upper radiating slot (101 . . . 304) are orthogonal and four in number, the two longer segments being likewise made in the long direction of said upper element (3, 23).

10. A multiband antenna (1, 20) according to claim 1, characterized in that said lower and upper elements (2, 22; 3, 23) and said ground element (11, 31) are substantially rectangular.

11. A multiband antenna (1) according to claim 10, characterized in that said lower and upper rectangular elements (2, 3) are disposed substantially in the vicinity of the middle of said rectangular ground element (11), the long directions of said lower and upper elements being parallel to the long direction of said ground element.

12. A multiband antenna (20) according to claim 10, characterized in that said lower and upper rectangular elements (22, 23) are disposed substantially in the vicinity of one end of said rectangular ground element (31), the width directions of said lower and upper rectangular elements being parallel to the length direction of said ground element.

13. A multiband antenna (1, 20) according to claim 1, characterized in that said first short circuit element (4, 24) is of the plane type.

14. A multiband antenna (1, 20) according to claim 13, characterized in that said second and third short circuit elements (5, 6) are of wire type and are disposed in a director plane that is not parallel to said first short circuit element (4, 24) of the plane type.

15. A multiband antenna (1) according to claim 14, characterized in that said director plane is substantially orthogonal to said first short circuit element (4) of plane type.

16. A multiband antenna (1, 20) according to any one of claims 1 to 3 and 4 to 15, characterized in that the length of said lower radiating slot (9, 29) is greater than 65 mm and the length of said upper radiating slot (10, 30) is greater than 70 mm.

17. A multiband antenna (1, 20) according to claim 13, characterized in that said first short circuit element (4, 24) is substantially orthogonal to said ground element (11, 31).

18. A multiband antenna (1, 20) according to claim 1, characterized in that said second and third short circuit elements (5, 6) are of the wire type.

19. A radiocommunications terminal including an antenna (1, 20) according to claim 1.

20. A multiband antenna (1, 20) comprising:

a plane type ground element (11, 31);

a plane type "lower" active radiating element (2, 22) superposed on and parallel with said ground element, and including at least one "lower" slot (9, 29);

a plane type "upper" active radiating element (3, 23) superposed on and parallel with said lower element, and including at least one "upper" slot (10, 30);

said lower element being electrically connected to said upper element by a first short circuit element (4, 24), and said lower element also being connected to said ground element by a second short circuit element (5);

a primary signal source (7, 27) connected at one end to a generator and fixed at its other end to one of said radiating elements;

a "lower" thin sheet (12, 32) of a first dielectric material filling a space between said lower element and said ground element; and an "upper" thin sheet (13, 33) of a second dielectric material filling a space between said lower and upper elements;

the antenna being characterized in that it further comprises a third short circuit element (6) electrically connecting said lower element and said ground element, in that at least one lower slot and at least one upper slot are radiating slots, in that said lower and upper radiating slots (9, 29; 10, 30) are each of a length that is greater than the longest dimension of each of said lower and upper elements (2, 22; 3, 23), in that said lower and upper radiating slots (9, 29; 10, 30) are of different sinuous shapes, and in that said lower and upper radiating slots (9, 29; 10, 30) comprise a plurality of continuous segments (91 . . . 304), said segments of said lower radiating slots (91 . . . 294) are of widths less than 0.5 mm, and said segments of said upper radiating slots (101 . . . 304) are of widths less than 0.5 mm.

21. A multiband antenna (1, 20) according to claim 20, characterized in that said lower radiating slot (9, 29) is open-ended and said segments of said lower radiating slot (91 . . . 294) are orthogonal and four in number, the longer two segments being made in the long direction of said lower element (2, 22), and in that said upper radiating slot (10, 30)

is open-ended and said segments of said upper radiating slot (101 . . . 304) are orthogonal and four in number, the two longer segments being likewise made in the long direction of said upper element (3, 23).

22. A multiband antenna (1, 20) according to claim 20, characterized in that all of said segments (91 . . . 304) are of substantially the same width which is equal to 0.1 mm.

23. A multiband antenna (1, 20) comprising:

a plane type ground element (11, 31);

a plane type "lower" active radiating element (2, 22) superposed on and parallel with said ground element, and including at least, one "lower" slot (9, 29);

a plane type "upper" active radiating element (3, 23) superposed on and parallel with said lower element, and including at least one "upper" slot (10, 30);

said lower element being electrically connected to said upper element by a first short circuit element (4, 24), and said lower element also being connected to said ground element by a second short circuit element (5);

a primary signal source (7, 27) connected at one end to a generator and fixed at its other end to one of said radiating elements;

a "lower" thin sheet (12, 32) of a first dielectric material filling a space between said lower element and said ground element; and an "upper" thin sheet (13, 33) of a second dielectric material filling a space between said lower and upper elements;

the antenna being characterized in that it further comprises a third short circuit element (6) electrically connecting said lower element and said ground element, in that at least one lower slot and at least one upper slot are radiating slots, in that said first short circuit element (4, 24) is of the plane type, and in that said second and third short circuit elements (5, 6) are of wire type and are disposed in a director plane that is not parallel to said first short circuit element (4, 24) of the plane type.

24. A multiband antenna (1) according to claim 23, characterized in that said director plane is substantially orthogonal to said first short circuit element (4) of plane type.

25. A multiband antenna (1, 20) comprising:

a plane type ground element (11, 31);

a plane type "lower" active radiating element (2, 22) superposed on and parallel with said ground element, and including at least one "lower" slot (9, 29);

a plane type "upper" active radiating element (3, 23) superposed on and parallel with said lower element, and including at least one "upper" slot (10, 30);

said lower element being electrically connected to said upper element by a first short circuit element (4, 24), and said lower element also being connected to said ground element by a second short circuit element (5);

a primary signal source (7, 27) connected at one end to a generator and fixed at its other end to one of said radiating elements;

a "lower" thin sheet (12, 32) of a first dielectric material filling a space between said lower element and said ground element; and an "upper" thin sheet (13, 33) of a second dielectric material filling a space between said lower and upper elements;

the antenna being characterized in that it further comprises a third short circuit element (6) electrically connecting said lower element and said ground element, in that at least one lower slot and at least one upper slot are radiating slots, and in that the length of said lower radiating slot (9, 29) is greater than 65 mm and the length of said upper radiating slot (10, 30) is greater than 70 mm.

* * * * *